US011511552B2

(12) United States Patent
Pousaz et al.

(10) Patent No.: US 11,511,552 B2
(45) Date of Patent: Nov. 29, 2022

(54) INKJET PRINTING MACHINE FOR PRINTING INDIVIDUAL SHEETS

(71) Applicant: MOUVENT AG, Solothurn (CH)

(72) Inventors: David Pousaz, Aubonne (CH); Olivier Freymond, Neyruz-sur-Moudon (CH); Romain Bersier, Penthalaz (CH); Jean-Philippe Besson, Chavannes-pres-Renens (CH); Nicolas Mosetti, Froideville (CH)

(73) Assignee: BOBST MEX SA, Mex (CH)

( * ) Notice: Subject to any disclaimer, the term of this patent is extended or adjusted under 35 U.S.C. 154(b) by 151 days.

(21) Appl. No.: 17/268,416

(22) PCT Filed: Aug. 14, 2018

(86) PCT No.: PCT/EP2018/072054

§ 371 (c)(1),
(2) Date: Feb. 12, 2021

(87) PCT Pub. No.: WO2020/035135

PCT Pub. Date: Feb. 20, 2020

(65) Prior Publication Data

US 2021/0316559 A1 Oct. 14, 2021

(51) Int. Cl.
*B65H 5/14* (2006.01)
*B41J 13/08* (2006.01)
(Continued)

(52) U.S. Cl.
CPC ..... *B41J 13/08* (2013.01); *B41J 2/01* (2013.01); *B41J 13/0054* (2013.01); *B65H 5/085* (2013.01); *B65H 5/14* (2013.01); *B65H 2301/44331* (2013.01); *B65H 2405/3521* (2013.01); *B65H 2405/55* (2013.01); *B65H 2406/10* (2013.01); *B65H 2406/423* (2013.01)

(58) Field of Classification Search
CPC ..... B41J 13/08; B41J 2/01; B41J 13/0054; B65H 5/085; B65H 5/14; B65H 2301/44331; B65H 2405/3521; B65H 2405/55; B65H 2406/10; B65H 2406/423
See application file for complete search history.

(56) References Cited

U.S. PATENT DOCUMENTS 4,834,232 A 5/1989 Freermann
7,011,307 B2 * 3/2006 Obama ..... B65H 7/02 271/265.01
(Continued)

FOREIGN PATENT DOCUMENTS

CN 2635626 Y 8/2004
CN 101171135 A 4/2008
(Continued)

OTHER PUBLICATIONS

International Search Report dated May 6, 2019 in counterpart International Patent Application No. PCT/EP2018/072054 (4 pages, in English).

*Primary Examiner* — Yaovi M Ameh
(74) *Attorney, Agent, or Firm* — Bookoff McAndrews, PLLC

(57) ABSTRACT

An inkjet printing machine for printing individual sheets comprises at least one printing station and a transport system defining a transport track for transporting the individual sheets through the printing station, along a transport direction. The transport system comprises a plurality of gripper conveyors (150) running along the transport track for holding the individual sheets during a printing process in the printing station. Each of the gripper conveyors (150) comprises an energy storage (161) for providing energy for operating a gripper mechanism (171) of the gripper conveyor (150). The printing machine allows for efficient and flexible handling of individual sheets, in particular large format sheets of materials such as corrugated cardboard or other materials that have a certain degree of inherent stability.

15 Claims, 6 Drawing Sheets

(51) Int. Cl.

| | |
|---|---|
| ***B41J 2/01*** | (2006.01) |
| ***B41J 13/00*** | (2006.01) |
| ***B65H 5/08*** | (2006.01) |

(56) References Cited

U.S. PATENT DOCUMENTS

| | | | | |
|---|---|---|---|---|
| 8,967,792 | B2 | 3/2015 | Atwood et al. | |
| 2013/0215164 | A1 | 8/2013 | Mayumi et al. | |
| 2014/0160213 | A1* | 6/2014 | Atwood | B41J 11/0085 347/101 |
| 2015/0049150 | A1* | 2/2015 | Muench | B41J 13/22 347/104 |

FOREIGN PATENT DOCUMENTS

| | | | |
|---|---|---|---|
| CN | 103140353 | A | 6/2013 |
| CN | 107352298 | A | 11/2017 |
| CN | 108137252 | A | 6/2018 |
| DE | 102012007606 | A1 | 10/2013 |
| DE | 102016224313 | A1 | 7/2017 |
| DE | 102017205868 | A1 | 11/2017 |
| EP | 0621221 | A2 | 10/1994 |
| EP | 1721750 | A1 | 11/2006 |
| WO | 2006120166 | A | 11/2006 |
| WO | 2017011923 | A1 | 1/2017 |
| WO | 2017011924 | A1 | 1/2017 |

* cited by examiner

INKJET PRINTING MACHINE FOR PRINTING INDIVIDUAL SHEETS

CROSS-REFERENCE TO RELATED APPLICATION(S)

This is a National Stage under 35 U.S.C. § 371 of International Application No. PCT/EP2018/072054, filed on Aug. 18, 2018, the contents of which are incorporated by reference in its entirety.

TECHNICAL FIELD

The invention relates to an inkjet printing machine for printing individual sheets, the machine comprising at least one printing station and a transport system defining a transport track for transporting the individual sheets through the printing station, along a transport direction.

BACKGROUND ART

Inkjet printing machines for the printing of individual sheets, such as sheets of corrugated cardboard, are known. Such machines often feature carriers for holding the sheets. Different approaches for securely holding the sheets to these carriers have been proposed.

As an example, U.S. Pat. No. 8,967,792 B2 (Xerox) describes a printing system having movable platen carts for handling the sheets. The platen carts include a cart frame configured to translate along a process track. A media platen is secured to the cart frame, and the media platen has a foraminous upper surface for receiving the substrate media sheet. The media platen has a subsurface cavity in fluid communication with the foraminous upper surface. A vacuum port is provided for evacuating air from the cavity, and a valve is provided for selectively closing and opening the vacuum port. The chamber maintains a vacuum when the sheet is on the media platen upper surface and the vacuum port is disconnected from a vacuum source. Therefore, during transport of the sheet, no tether or fixed line support is required to maintain the vacuum.

The vacuum system requires heavy components. The full surface of the sheet needs to be supported and adjustment of the carts to varying sheet sizes is difficult.

Other approaches for holding sheets are known. DE 10 2012 007 606 A1 (Heidelberger) proposes the use of gripper carriages for holding sheets to be punched in a punching system. The grippers of the carriages are opened and closed by mechanical interaction with a stationary cam.

This requires that the energy for opening and closing the gripper is provided by means of the mechanical interaction during opening or closing, respectively. If higher clamping forces are needed the forces and/or the interaction time between the respective elements on the carriage and the cam need to be increased. This may lead to a more complicated design of the carriages and/or the stationary elements of the transport system and thus to reduced flexibility with respect to the processing of different sheet formats and/or to reduced throughput.

SUMMARY OF THE INVENTION

It is the object of the invention to create a printing machine pertaining to the technical field initially mentioned, that allows for an increased flexibility and high throughput.

The solution of the invention is specified by the features of claim 1. According to the invention the printing machine comprises a) at least one printing station;

b) a transport system defining a transport track for transporting the individual sheets through the printing station, along a transport direction;

the transport system comprising a plurality of gripper conveyors running along the transport track for holding the individual sheets during a printing process in the printing station, wherein each of the gripper conveyors comprises an energy storage for providing energy for operating a gripper mechanism of the gripper conveyor.

Usually, the transport track will not only run through the printing station but through further stations upstream and/or downstream of the printing station, such as drying or varnishing stations. Preferably, the transport track is straight, such that all these stations may be arranged in succession, along a straight line, having their interaction spaces at the same height.

Similarly, the gripper conveyors will not only hold the individual sheets during the printing process but during further processing steps upstream or downstream the printing step(s).

Having an energy storage on the gripper conveyor for providing energy for operating the conveyor's gripper mechanism avoids the need for energy supply at the time of operating the gripper mechanism. Thus, in preferred embodiments, energy is supplied prior to operation. This allows for simplifying the design of the conveyors and their interaction with the transport system.

Compared to a vacuum system interacting with the entire surface of the sheets, grippers may be constructed with less weight, and adjustment of grippers to different sheet formats is easier.

The inventive printing machine thus allows for efficient and flexible handling of individual sheets, in particular large format sheets of materials such as corrugated cardboard or other materials that have a certain degree of inherent stability (such as thick cardboard sheets, plastic sheets, thin metal sheets etc.).

In a preferred embodiment, the energy storage comprises a compressed air reservoir for operating the gripper mechanism.

In a preferred embodiment, the gripper mechanisms have a clamping bar with cross members. In this case, the compressed air from the reservoir may be used to clamp and/or to unclamp the clamping bar. In a particularly preferred embodiment, the compressed air may be selectively injected into an elastic tube-like structure, which opens the clamping bar by moving one of the cross members away from the other cross member. As soon as the tube-like structure is deflated, e. g. by opening a corresponding vent, the two cross members will be moved together due to the force of a spring. Advantageously, the spring is constituted by one of the cross members, i. e. the respective cross member has suitable elastic properties and cooperates with the other cross member to clamp the sheet edge.

Advantageously, the transport system comprises a supply station for supplying compressed air to the compressed air reservoir. In particular, the supply station allows for recharging the compressed air reservoir essentially each time a gripper conveyor passes the supply station. Accordingly, the storage volume of the air reservoir may be chosen to match the (maximum) amount of air needed during subsequent passages of the supply station.

Preferably, the supply station comprises a movable air supply interface for moving with one of the gripper conveyors, along a path section of the gripper conveyor. This allows for recharging the air reservoir during movement of the gripper conveyor, thus extending the available time for recharging. Several (movable) air supply interfaces may be provided in order to increase throughput.

Alternatively, instead of compressed air reservoirs other means of energy storage, e. g. mechanical means (such as springs), electrochemical means (such as rechargeable batteries) or electrical means (such as condensators or so-called "supercaps") may be employed.

Preferably, movement of each of the gripper conveyors along the transport track is individually controllable. This means in principle that movement of a given gripper conveyor may be controlled independently from the movement of every other gripper conveyor (or further moveable units interacting with the transport track). It is to be noted that during operation of the printing machine movements of several gripper conveyors will usually be synchronized, and there may be constraints with respect to the relative positions and movements of several gripper conveyors that have to be taken into account when controlling the movement of the conveyors.

In a preferred embodiment, the transport system comprises a linear motor being controllable in such a way that movement of each of the gripper conveyors along the transport track is individually controllable. The linear motor comprises a fixed track, e. g. a rail-like track, and moveable parts arranged on the gripper conveyors. The track and the moveable parts constitute the stator and the rotor (secondary) of the linear motor, respectively.

Preferably, the gripper conveyors comprise permanent magnets forming a rotor (secondary) of the linear motor, the stationary rail of the linear motor forming a stator of the linear motor. This allows for having passive gripper conveyors that do not need an external energy supply for individual movement along the transport track or the entire circulating track, respectively. Energy supply for movement of the gripper conveyors is effected to the stationary stator interacting with the permanent magnets on the gripper conveyors.

In combination with the energy storage the gripper conveyors are autonomous during their movement along the transport track. In this phase, complicated interactions with the stationary part of the machine are avoided, and the conveyors may still be lightweight and compact.

In a preferred embodiment, the printing machine comprises a plurality of successively arranged modules, each of the modules comprising a section of a rail of the linear motor, neighboring modules being mechanically linkable to each other. This allows for easily building up printing machines having different set-ups, i. e. with respect to the number of stations (printing, drying, varnishing etc.), as well as for removing and replacing individual modules for repair or maintenance. Each of the modules may comprise all power supply and control electronics for the respective section of the linear motor. The control electronics of all the modules will be connected to a central control unit, e. g. by means of a data bus.

Preferably, the transport system comprises a circulating track, wherein the plurality of gripper conveyors is running along the circulating track and wherein the transport track forms a section of the circulating track. Having a circulating track simplifies the recirculation of the gripper conveyors, no additional recirculation system is needed, and the gripper conveyors are always arranged on the track, i. e. during normal operation, no introduction or removal of gripper conveyors is required. During operation of the printing machine, the gripper conveyors will usually stand still or move in a single predetermined direction.

Advantageously, the circulating track extends in a first plane, and the gripper conveyors are guided along the circulating track in such a way that along the transport track a main surface of individual sheets held by the gripper conveyors extends in a second plane, the second plane being perpendicular to the first plane and oriented along the transport direction (i. e. the direction of movement along the transport track). In particular, the first plane is oriented in a vertical direction, the second plane as well as the transport direction are oriented horizontally. This means that the footprint of the printing machine is not substantially affected by having a circulating track, as the recirculation of the gripper conveyors happens below (preferred) or above the transport track.

As an alternative to having a linear motor with a circulating track, a linear motor or other means for transporting the conveyors may be used for a straight track including the transport track, and further means are provided for recirculating the gripper conveyors to the start of the linear track.

Preferably, in embodiments having a circulating track, a supply station for compressed air is arranged in a region of the circulating track outside the transport track for the individual sheets. Accordingly, there is no interference between the processing of the transported sheets (along the transport track) and the refill with compressed air (outside the transport track). Thus the process is simplified and throughput is maximized.

In a preferred embodiment, at least one of the plurality of gripper conveyors comprises a gripper mechanism for gripping a leading edge of one of the individual sheets and at least one of the plurality of gripper conveyors comprises a gripper mechanism for gripping a trailing edge of the individual sheet. It is possible to employ dedicated gripper conveyors for gripping the leading edge and dedicated gripper conveyors for gripping the trailing edge, or it is possible to use gripper conveyors that may selectively grip the leading or the trailing edge. In principle, also gripper conveyors may be used that may simultaneously grip the trailing edge of a first sheet as well as the leading edge of a second sheet upstream the first sheet. In any case, during the printing process an individual sheet will be gripped by at least two gripping conveyors that are individually movable with respect to each other.

If the gripper conveyors are individually controllable, the machine is easily readjusted for different sheet formats. There is no need for having a cart or carrier the dimensions of which matching the dimensions of the sheets to be processed, but the readjustment of the relative distance of the gripper conveyors for gripping the leading edge and the trailing edge, respectively, is sufficient for adapting the machine to different sheet dimensions in the transport direction (length). With respect to the sheet dimension across the transport direction (width), at least in the case of rectangular sheets, it does not matter if the grippers exceed the sheet width.

Due to the fact that the dimensions of the gripping conveyors along the transport direction may be chosen to be much shorter than the length of the individual sheets, the movable units of the transport system are much smaller and lighter than the carts or carriers of the prior art, thus allowing for faster dynamics and higher throughput.

Preferably, the individual sheets are held by the gripper conveyors in such a way that a major extension of the sheets extends across a transport direction of the transport track. This reduces the tendency and magnitude of bending. Using the two gripper conveyors, gripping the sheet along both the leading and the trailing edge, the remaining deformations along the transport direction may be controlled and/or compensated.

Especially in the case of smaller substrates it may not be necessary to transport them in a manner where the major extension extends across the transport direction. Conversely, in the case of substrates having a very long extension in one direction, they may only be supplied to the printing machine when the long extension coincides with the transport direction. However, in this case, additional measures to ensure a certain degree of flatness will usually be required, such as the use of one or several support conveyors as described below.

Preferably, after gripping, a distance between the first gripper conveyor and the second gripper conveyor is controlled in such a way that a tensioning force is applied to the individual sheet for straightening the individual sheet. This reduces bending of the sheet along the transport direction. Using the individually controllable conveyors, the tensioning force may be precisely controlled.

In a preferred embodiment, the gripper mechanism comprises a clamping bar including a first cross member and a second cross member, a relative distance of the cross members being adjustable to clamp the leading edge and/or the trailing edge of the individual sheet. The cross members extend across the transport direction, their main extension is oriented perpendicular to the transport direction. The cross members may clamp individual sheets having a width up to a maximum width, defined by the main extension of the cross members. This maximum width will usually match the maximum width of the processing stations, such as the printing station, of the printing machine. Clamping sheets with a smaller width does not require any modification of the clamping bars.

Preferably, the transport system further comprises support conveyors for supporting individual sheets in a central portion thereof. Especially in the case of large substrates or substrates with low inherent stability, support conveyors improve the flatness of the sheets. In particular, a support conveyor is arranged in between every gripper conveyor for gripping the leading edge of a sheet and the subsequent gripper conveyor for gripping the trailing edge of the sheet. Preferably, the support conveyors are moved and controlled in the same way as the gripper conveyors, i. e. they interact with the linear motor and are individually controllable. It is possible to arrange more than one support conveyor in between two gripper conveyors holding the same sheet.

In other embodiments, no support conveyors are employed. This is feasible especially if the sheets have a high rigidity and/or if their longitudinal extension is rather short.

Preferably, the printing machine further comprises a feeding station for feeding individual (destacked) sheets to pairs of gripping conveyors. The sheet will first be gripped by the downstream gripper conveyor, gripping the leading edge of the sheet. Finally, it will be gripped by the upstream gripper conveyor, gripping the trailing edge of the sheet. If support conveyors are employed, in total three or more conveyors will be involved in transporting a single sheet.

Preferably, the feeding station comprises two groups of belts running in the transport direction, for pinching one of the individual sheets in between. This allows for precisely guiding the sheets and feeding the sheets to the gripper conveyors. In particular, it is possible for receiving the sheet by the feeding station in a predetermined position and orientation and feeding the sheet to the gripper conveyors without altering the orientation and in a position that is unambiguously related to the predetermined position.

Preferably, the feeding station comprising a group of belts running in the transport direction, provided with a vacuum system, wherein the group of belts overlaps with a feeding section of the transport track. This creates a section where the sheets are still held by the single group of belts and where the gripper conveyors may receive the sheets from the belts in a defined position and orientation. As soon as the sheet or a portion of the sheet is securely gripped, the sheet or the portion may be released from the belts. Most simply this is achieved if the downstream end of the belts coincides with this release position.

In a particularly preferred embodiment, the feeding station comprises a first section having two groups of belts for pinching the sheets in between and downstream of the first section a second section with a single group of belts and a vacuum system.

In alternative embodiments, instead of the vacuum system, the feeding station features other means for holding the sheets.

Preferably, the printing station comprises a plurality of inkjet print bars, the print bars covering a print area extending across the transport track for the individual sheets. In preferred embodiments, the print bars are essentially fixed in a lateral direction, and they cover the whole width of the print area all the time. In other embodiments, scanning print bar arrangements are employed.

In general, the invention may be applied to other kinds of printing systems.

Advantageously, the printing machine further comprises an absorbing conveyor for absorbing excess ink when moved to an absorbing position opposite at least one of the print bars, the absorbing conveyor being movable along the transport track. Absorption of excess ink is particularly needed when the nozzles of ink jet print bars are flushed. Having an absorbing conveyor simplifies the cleaning or flushing process considerably. Preferably, the absorbing conveyor is moved and controlled in the same way as the gripper conveyors, i. e. it interacts with the linear motor and is individually controllable. It is possible to employ one or several absorbing conveyors.

Preferably, the absorbing conveyor comprises a sponge-like element. This allows for easily and reliably accommodating the excess ink.

In a preferred embodiment, the print bars are individually and dynamically movable in an adjustment direction perpendicular to a main surface of the individual sheets to be printed, such that a distance between the print bars and the respective sheet is dynamically adjustable. This means that an adjustment is possible during the passing of a certain sheet through the printing machine. In particular, this allows for keeping the distance between print bars and substrate essentially constant, even if the substrate exhibits bending along the transport direction.

The individual adjustability of the print bars as well as taking the respective measurements and controlling respective drives is advantageous not only in the context of the present invention. It is also applicable in connection with printing machines (especially printing machines for large substrates) where the gripper conveyors do not comprise an energy storage for operating a gripper mechanism.

Preferably, the printing machine comprises a detection unit for recording a profile of one of the individual sheets to be printed, in particular for recording a bending along the transport direction, and further comprising a control unit for controlling a movement of the print bars in the adjustment direction, based on the recorded bending of the sheet.

Accordingly, in an inventive process, preferably a profile of the individual sheet to be printed is recorded and a vertical position of each of a plurality of print bars of the printing station is individually controlled such that it corresponds to the recorded profile.

This allows for precisely following the profile of a respective sheet with the print bars, ensuring that a relative distance remains constant, thereby avoiding negative effects on the print quality due to varying distance between printing nozzle and sheet surface, which would lead to unacceptable dot placement errors.

In particular, the detection unit comprises a distance sensor for recording the profile. This allows for precisely and reliably recording the sheet profile. A suitable distance sensor is a laser curtain. Other types of sensors may be employed.

Preferably, the printing machine further comprises a robot for destacking individual sheets from a stack, the robot being arranged upstream the transport track.

Preferably, the printing machine further comprises a robot for stacking printed individual sheets, the robot being arranged downstream the transport track.

Preferably, the printing machine comprises a detection device for capturing positions and orientations of two gripping conveyors assigned to an individual sheet and further comprises a control device for controlling the printing station to compensate for positional inaccuracies of the individual sheet transported by the two gripping conveyors.

This allows for achieving a high quality printed image essentially without distortions, positional or directional errors.

In particular, the detection device comprising detectors for capturing two positions on each of the gripping conveyors, the two positions being distant from each other. This allows for not only determining the exact position of the respective conveyor along the transport track but also for determining the exact orientation with respect to the transport direction. Employing gripping conveyors having a geometry that unambiguously determines the relative position of the respective sheet with respect to the conveyor as well as measuring positions on the conveyor allows for a precise determination of the sheet position and orientation without having to capture the sheet itself or markings thereon.

Preferably, the detectors are arranged independent from the gripping conveyors. In particular, the gripping conveyor includes markings, in particular ruler-type markings, and the detectors (in particular optical detectors) are stationary, capturing the markings when they are passed by the respective conveyor.

Other advantageous embodiments and combinations of features come out from the detailed description below and the entirety of the claims.

BRIEF DESCRIPTION OF THE DRAWINGS

The drawings used to explain the embodiments show.

In the figures, the same components are given the same reference symbols.

PREFERRED EMBODIMENTS

Figure 1A:
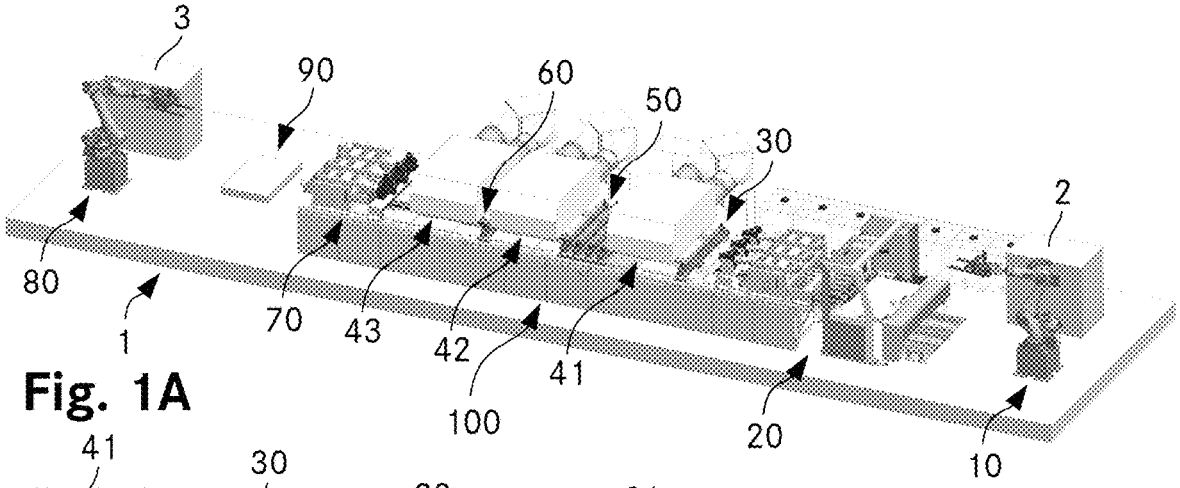
FIG. 1A An oblique view of a printing machine according to the invention.
Figure 1B:
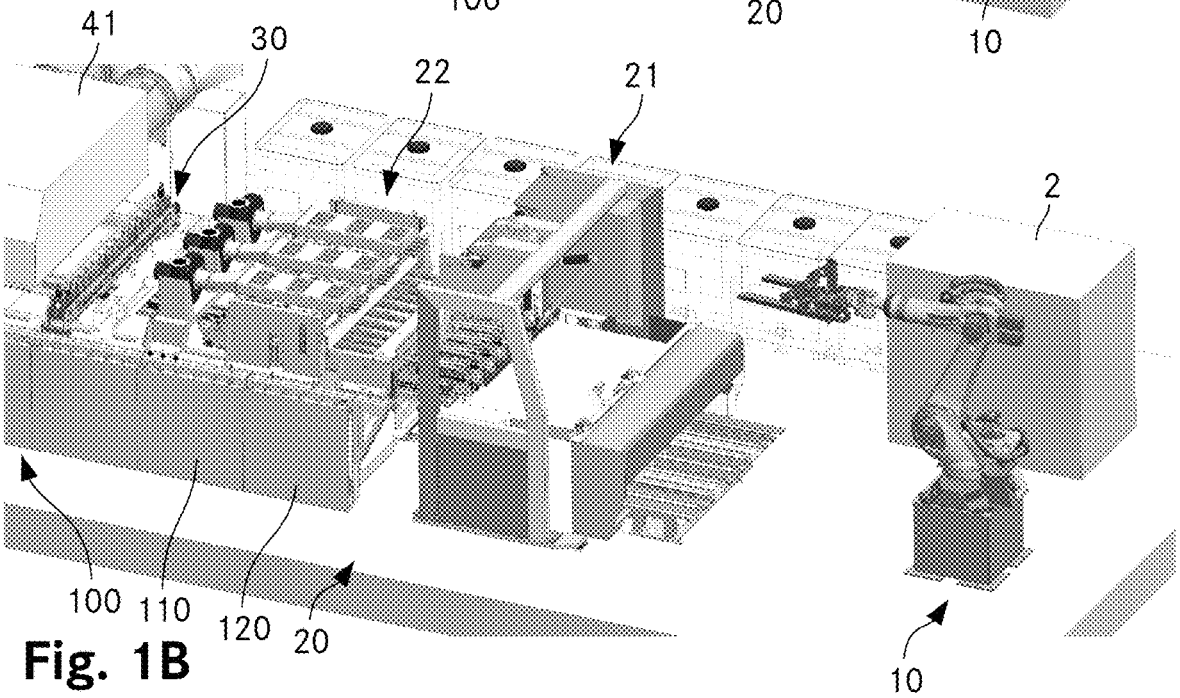
FIG. 1B, 1C detail views of FIG. 1A showing the starting and end sections of the machine, respectively.
Figure 1C:
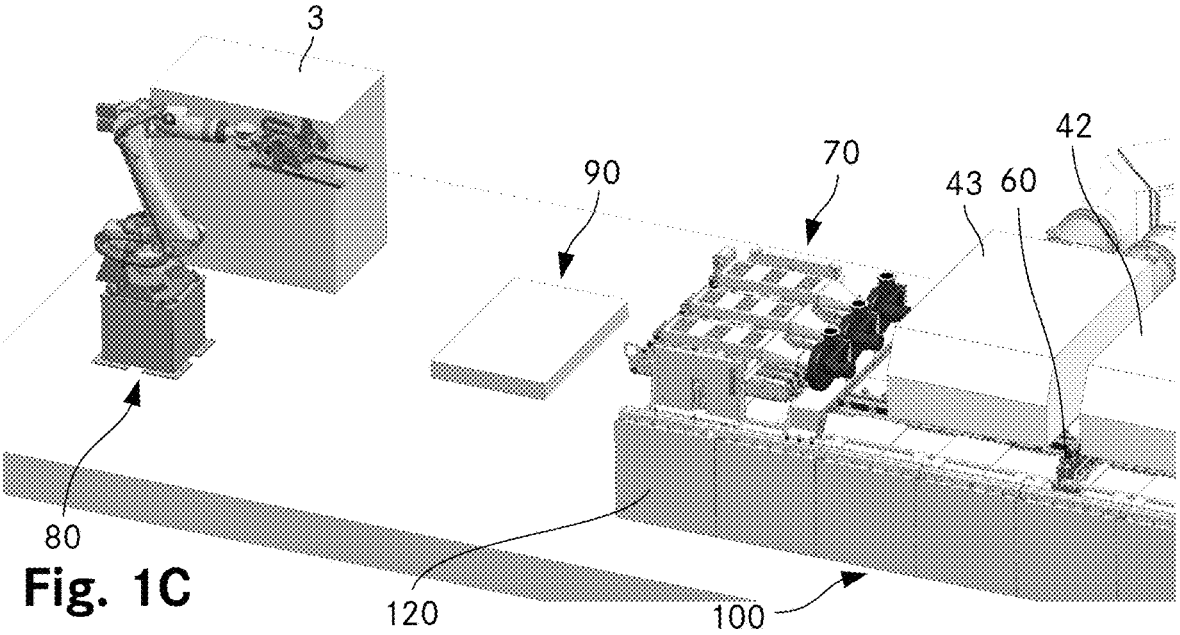

The FIG. 1A is an oblique view of a printing machine according to the invention, the FIGS. 1B, 1C are detail views of FIG. 1A showing the starting and end sections of the machine, respectively.

The printing machine 1 according to the shown embodiment is a continuously operated single pass inkjet printing machine for printing individual sheets, e. g. from corrugated cardboard. The maximum format of the individual sheets is 2.1×1.3 m (width×length). Typical thicknesses of corrugated cardboard that may be processed with the machine range from 0.7 to 7.0 mm. The achievable speed is 100 m/min (about 1 sheet per second), the printing resolution is 1'200 dpi. The printing machine is capable of printing water-based ink, e. g. for the printing of food packaging.

The printing machine 1 includes in succession a destacking robot 10 for destacking individual sheets from an input stack 2, a feeding station 20, a precoating station 30, a first drying station 41, a printing station 50 for four-colour inkjet printing, a second drying station 42, a varnishing station 60, a third drying station 43, a removal station 70 and a stacking robot 80 for stacking the processed individual sheets onto an output stack 3. An accommodating space 90 is provided between the removal station 70 and the stacking robot 80. It may accommodate a further station such as a quality control station. A circulating transport system 100 extends from the feeding station 20 to the removal station 70. It is described in more detail below.

All drying stations 41, 42, 43 are built alike, in a manner known as such, providing infrared and warm air drying. The destacking robot 10 and the stacking robot 80 are articulated arm robots and built alike, featuring gripper means for gripping partial stacks of individual sheets. The printing station 50 as well as the precoating station and the varnishing station 60 are based on print bars extending over the entire width of the machine. A suitable print bar technology is described in WO 2017/011923 A1 and WO 2017/011924 A1 (filed by Radex A G, now Mouvent S A).

The input stack 2 has a typical height of about 2 m. From the input stack 2, the destacking robot 10 seizes partial stacks having a height of about 20 cm, turns them over and feds them to the feeding station 20. The feeding station 20 is constituted of a first unit 21 and a second unit 22. The first unit 21 comprises a sheet lift and a number of manipulators. The sheet lift receives a partial stack from the destacking robot 10. The sheets of the partial stack are lifted by the sheet lift. The uppermost sheet is seized by a lateral bar, using a vacuum system, the present lateral position is determined and the sheet is positioned in an exact predetermined lateral position. The orientation is ensured by suitable guides. This exact lateral position and orientation of the sheet is maintained until the sheet is seized by the circulating transport system 100.

The sheet is then fed to the second unit 22 comprising in a first stage a set of upper transport bands and a set of lower transport bands. All transport bands extend in the longitudinal direction, parallel to the transport direction of the sheets. In the first stage, the sheets are received between the two sets of transport bands. In a second stage of the second unit 22, the sheets are attached to the top set of belts only, using a vacuum system. It is from this second stage where the sheets are seized by the circulating transport system 100. The belt and vacuum system ensures that the sheets are provided in a flat state, their lateral position and orientation corresponding to that defined by the first unit of the feeding station 20.

The removal station 70 basically corresponds to the second stage of the second unit 22 of the feeding station 20, i. e. the processed sheets are received from the circulating transport system 100 by means of a set of upper vacuum belts. These belts transport the sheets one by one to the next station.

Figure 2A:
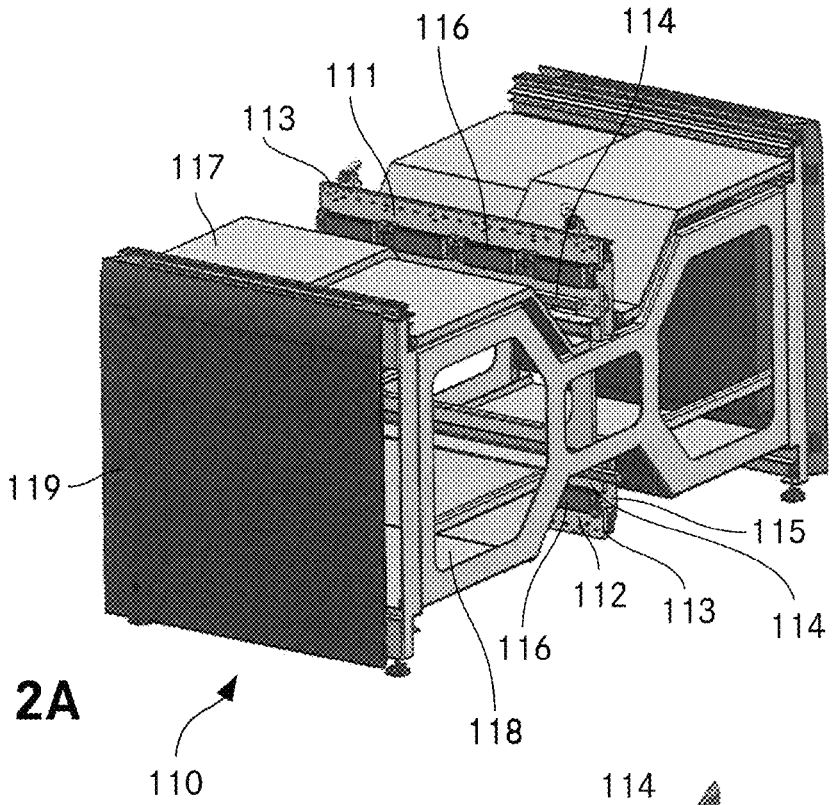
FIG. 2A, 2B an oblique view of a track module with closed and open shutters.
Figure 2B:
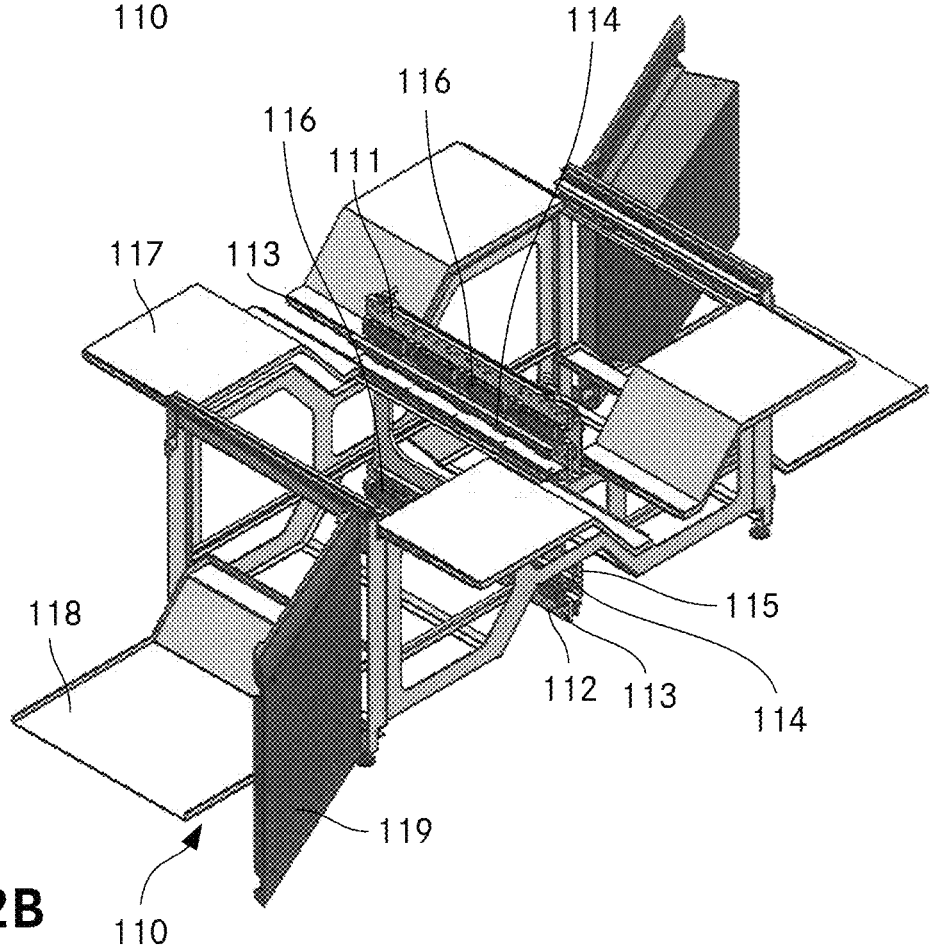

The FIGS. 2A, 2B show an oblique view of a track module with closed and open shutters, respectively. The circulating transport system 100 is composed of a number of such modules. In addition to the track modules 110, one of them shown in FIGS. 2A, 2B the transport system 100 comprises end modules 120 (cf. FIGS. 1B, 1C). Each of the track modules 110 provides two straight sections of the transport track, an upper section 111 and a lower section 112. The end modules 120 provide a curved section of the transport track, linking the lower track to the upper track, turning by 180°.

The track modules 110 comprise a machine frame 115 carrying the upper section 111 and the lower section 112. Both sections 111, 112 comprise a straight carrying rail 113 and a straight guide rail 114 arranged parallel to the carrying rail 113, in a predetermined distance. Furthermore, the sections 111, 112 comprise a number of electromagnets 116 each. The totality of upper sections 111, lower sections 112 and track sections of the end modules 120 constitute the linear motor for transporting the gripper conveyors along the circulating track as described in more detail below. The machine frame 115 further comprises structures extending along the upper lateral edges, for securely attaching stations or elements of stations, such as print bars or the elements of the feeding and removal stations.

The machine frame further carries a number of shutters, including slide shutters 117, hatches 118 and doors 119. As shown in FIG. 2B, these shutters allow for easy access to the interior of the track module 110. One of the doors 119 includes control and power electronics for the individual track module 110. Each module features its own power supply and data connection. Adjoining modules are connected by screw connections, ensuring that the tracks of the two modules fall in line. Once these screw connections are undone, each of the modules may be moved out of the line in a lateral direction for maintenance, repair or replacement. Furthermore, the modular buildup allows for easily constructing printing machines of different lengths or even for changing the length of a printing machine at a later stage, especially if stations are added to or removed from the machine.

Figure 3:
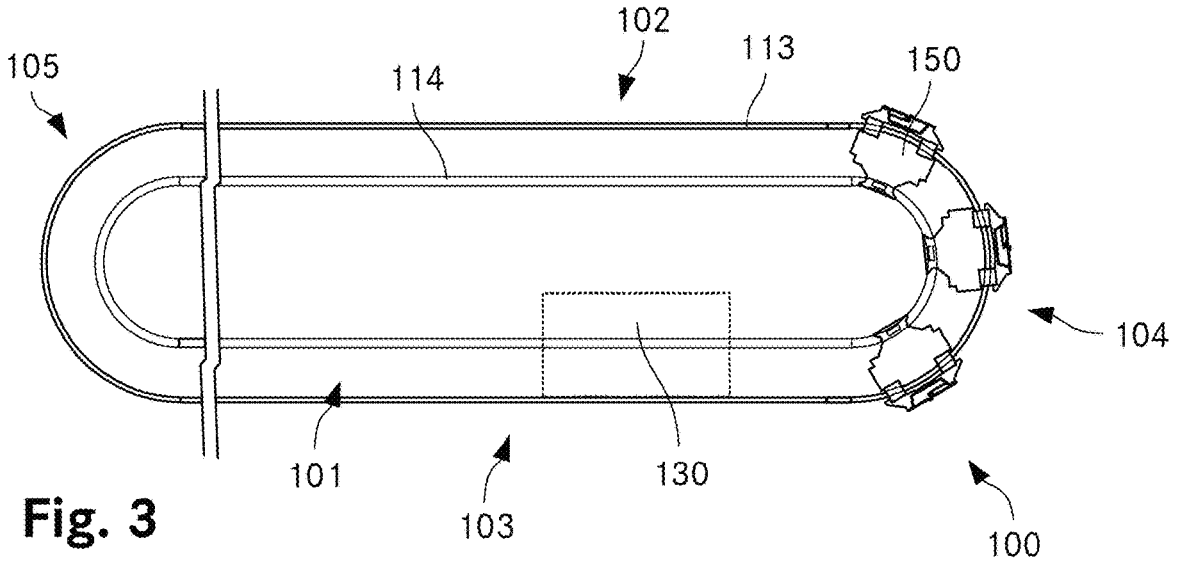
FIG. 3 a schematic side view of the circulating track of the machine.
Figure 4:
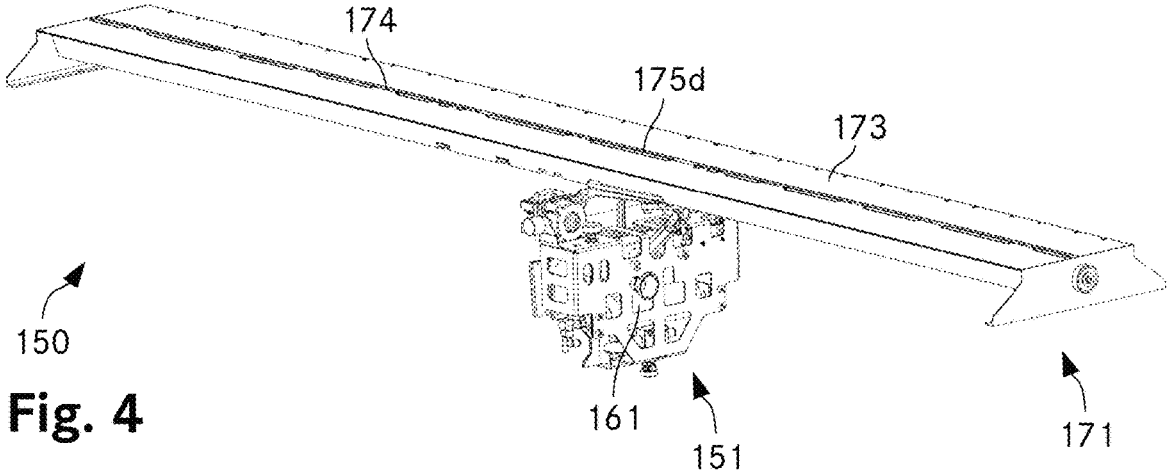
FIG. 4 an oblique view of a gripper conveyor.
Figure 6A:
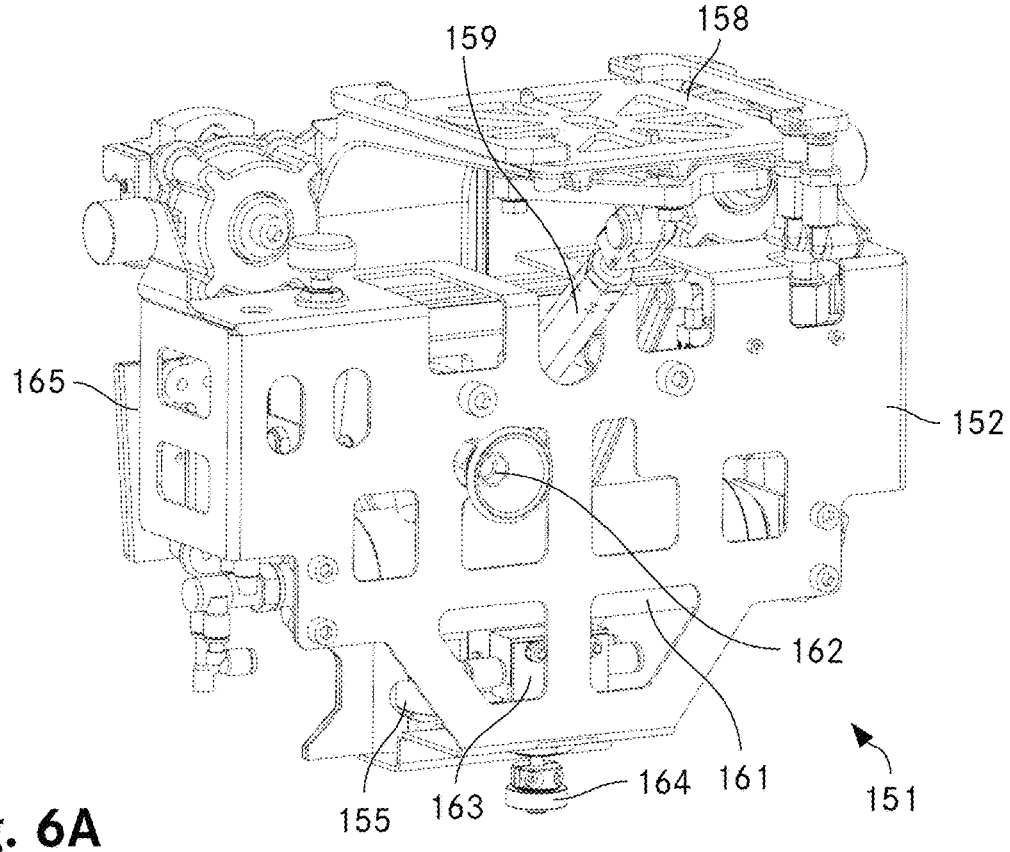
FIG. 6A, 6B two oblique views of the base part of the gripper conveyor.
Figure 6B:
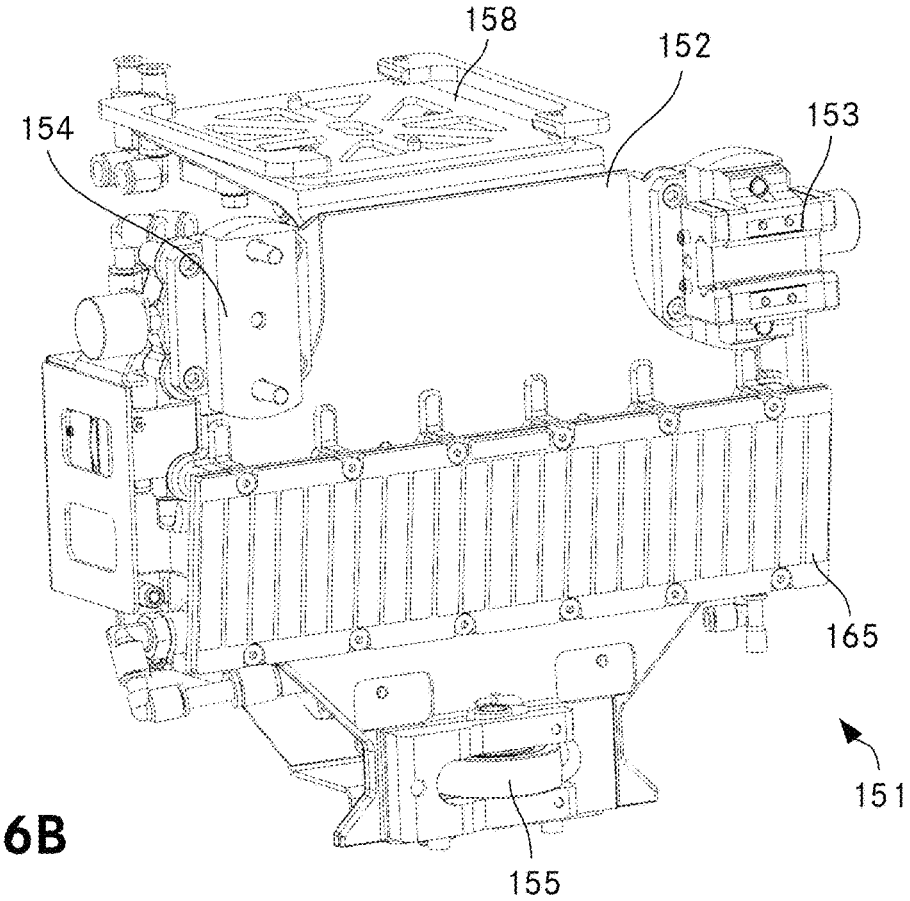
Figure 7:
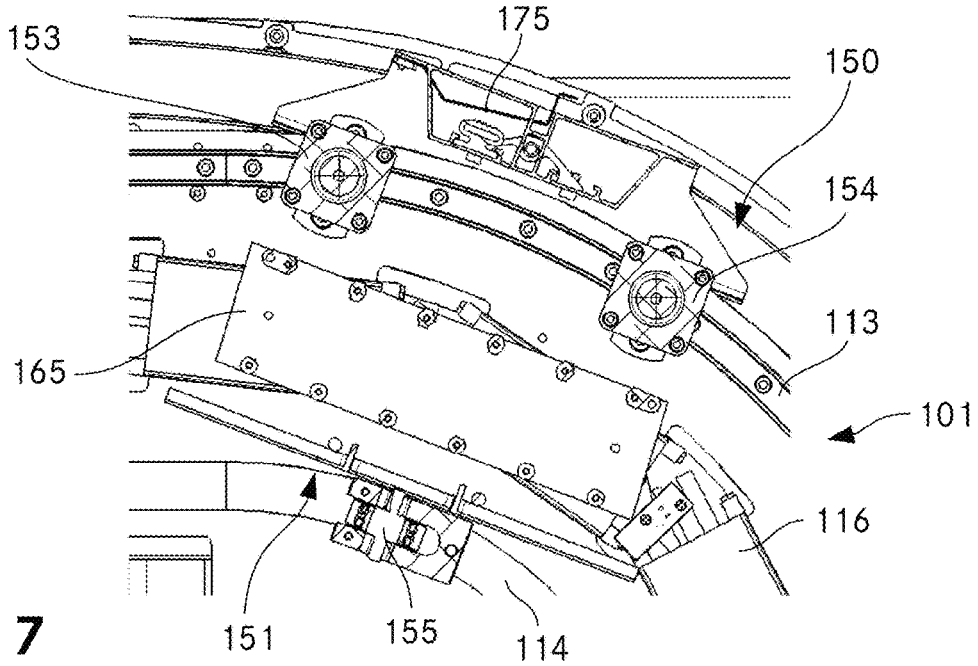
FIG. 7 a cross-sectional view illustrating the interaction between the gripper conveyor and the track.

The FIG. 3 is a schematic side view of the circulating track of the machine. The FIG. 4 shows an oblique view of a gripper conveyor, the FIG. 5 a side view of the clamping bar of the gripper conveyor, and the FIGS. 6A, 6B two oblique views of the base part of the gripper conveyor. The FIG. 7 is a cross-sectional view illustrating the interaction between the gripper conveyor and the track, along a plane between the housing and elements for interacting with the track, attached to or protruding from the housing.

The circulating transport system 100 includes a circulating track 101 constituted by an upper straight section 102, a lower straight section 103, a first turning section 104 (input side) and a second turning section 105 (output side), the turning sections 104, 105 linking the upper straight section 102 and the lower straight section 103. As described above, the upper straight section 102 and the lower straight section 103 are provided by the track modules 110, the turning sections 104, 105 are provided by the end modules 120. As described in connection with FIGS. 2A, 2B, the main components of the circulating track 101 are the carrying rail 113, the guide rail 114 and the electromagnets 116 (not shown in FIG. 3). The described track has a length of about 2×10 m plus the two turning sections, along the track the linear motor features about 90 electromagnets 116, 30 gripper conveyors are simultaneously interacting with the track 101. The gripper conveyors 150 (and further modules) interact with the carrying rail 113 at two points of contact and with the guide rail 114 at a further point of contact, as described in more detail below.

An air supply station 130 is provided in the lower straight section 103. It is described in more detail below, in connection with FIGS. 8A, 8B.

Figure 5:
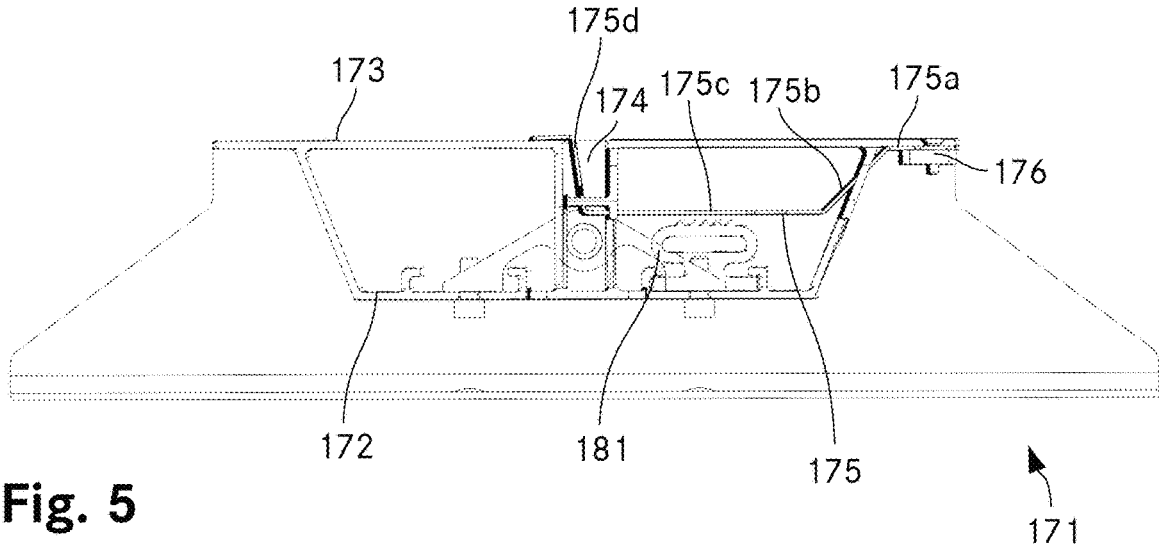
FIG. 5 a side view of the clamping bar of the gripper conveyor.

The gripper conveyor 150 includes a base part 151 and a clamping bar 171 mounted on top of the base part 151. The FIGS. 4, 5 show a clamping bar 171 which is designed to clamp a trailing edge of an individual sheet to be processed. The clamping bar 171 features a main profile 172, which is prismatic and has a basically trapezoid cross-section. The longer of the parallel sides of the trapezoid constitutes the upper surface of the clamping bar 171, together with extensions extending to both sides. The upper surface is a support surface 173 for the individual sheet to be processed. It features a slit 174 extending from one lateral end of the clamping bar 171 to the other.

A clamping spring 175 made of spring steel is attached to one of the extensions of the main profile 172. In cross section, a first section 175*a* of the clamping spring 175 is supported on the inner face of the extension and mounted to the main profile 172 by a mounting block 176 screwed to the extension. A second section 175*b* of the clamping spring 175 extends from the first section 175*a*, bent to the inside of the main profile 172 by an angle of about 45°. A third section 175*c* extends from the second section, bent to the upper surface of the clamping bar 171 by an angle of about 45°, i. e. the third section 175*c* extends parallel to the upper surface (support surface 173). Attached to the free end of the third section 175*c* are L-shaped clamping elements 175*d*, arranged along the whole length of the clamping spring 175, and penetrating the slit 174 in the support surface 173, the shorter leg of the clamping elements 175*d* being supported on the support surface 173, i. e. on the outside of the main profile 172.

The clamping bar 171 further comprises an elongated inflatable tube 181. It is attached to the section of the main profile 172 forming the shorter parallel side of the trapezoid and is arranged in between this section of the profile 172 and the third section 175*c* of the clamping spring 175. In the deflated state shown in FIG. 5, the tube 181 does not impact any force on the clamping spring 175, and due to its geometry and elasticity, the clamping spring 175 exerts a certain clamping force to the support surface 173 of the clamping bar 171.

The inflatable tube 181 is a closed air container and features a single access, linked to a vent. In an uninflated state, the tube 181 has an oval cross-section. By inflating the tube 181 with compressed air, the tube 181 changes its shape to a more circular cross-section, i. e. the height of the tube 181 increases and its width decreases. This has the effect that the third section 175*c* of the clamping spring 175 is contacted by the outer surface of the tube 181 and moved in the direction of the support surface 173. The clamping elements 175*d* are moved as well and their short legs are raised from the support surface 173, such that a gap is formed for receiving a sheet edge. The maximum gap height exceeds the maximum thickness of the substrates to be processed. In the shown case, the maximum gap height is 12 mm.

If the inflatable tube 181 is deflated again, the force between the tube 181 and the clamping spring 175 decreases to substantially zero, and the clamping force between the clamping spring 175 and the sheet (or the support surface 173) is reestablished due to the elasticity of the clamping spring 175.

The base part 151 comprises a housing 152. The housing 152 mounts two rail guides 153, 154, both including a rotational bearing, on which a guide element for interacting with a guide rail is mounted. In the FIG. 6B, one of the guide elements is displayed, the other is omitted for illustration purposes. The two rail guides 153, 154 are arranged near the upper edge of the housing 152, on the front as well as on the back end thereof. The rotational axes of the rotational bearings are parallel to each other and run perpendicular to a lateral surface of the housing 152. In a central section of the lower edge of the housing 152, a support roll 155 is mounted. The rotational axis of the support roll 155 runs parallel to the lateral surface of the housing 152 and perpendicular to the support surface 173 of a clamping bar 171 mounted to the base part 151.

Attached to the housing 152 is a holding part 158 for mounting a clamping bar 171 (as shown in FIGS. 4, 5). The holding part 158 is connected to the housing 152 by a mounting flange as well as by an adjustment lever 159, one of the lateral surfaces of the housing 152 and the holding part 158 forming an essentially L-shaped element, the adjustment lever 159 extending from the housing 152 to the free end of the leg forming the holding part 158. The adjustment lever 159 allows for precisely adjusting an angle between the longitudinal extension of the clamping bar 171 and the plane defined by the two rail guides 153, 154 and the support roll 155.

An air reservoir 161 is accommodated in the housing 152. An air interface 162 is connected to the air reservoir 161 by a line including a check valve. This allows for introducing pressurized air through the air interface 162 into the air reservoir 161. The air reservoir 161 is further connected to a multiport valve 163. This valve may be switched between two modes of operation by means of a control pin 164 arranged on an lower surface of the housing 152 as follows:

| control pin | line reservoir-tube | line tube-exterior | effect |
|---|---|---|---|
| not operated | closed | open | tube is deflated |
| operated (pressed) | open | closed | tube is inflated |

Finally, the base part 151 of the gripper conveyor 150 features a permanent magnet bar 165 for interacting with the electromagnets of the stationary part of the linear motor. The magnets are sealed in a slab of synthetic resin. The slab is mounted on a lateral surface of the housing 152, on the same side as the guide elements of the rail guides 153, 154.

The interaction of a gripper conveyor 150 with the carrying rail 113, the guide rail 114 and the electromagnets 116 of the circulating track 101 is discussed in connection with FIG. 7. It shows a part of the circulating track 101 in one of the end modules, where the track is curved. The two rail guides 153, 154 on the base part 151 of the gripper conveyor 150 interact with the carrying rail 113. They are constructed in such a way that lateral as well as normal forces may be transmitted between the gripper conveyor 150 and the carrying rail 113. There are three points of contact, ensuring a defined position of the conveyor with respect to the track at all times, also in the curved sections.

The permanent magnet bar 165 is arranged on the base part 151 in such a way that it aligns with one or two of the local electromagnets 116. The support roll 155 runs on a lateral surface of the guide rail 114 and supports the gripper conveyor 150 against tilting about an axis in the transport direction. By appropriately switching the electromagnets 116, the gripper conveyor 150 moves along the circulating track 101 in a predetermined direction with a predetermined individual velocity.

Figure 8A:
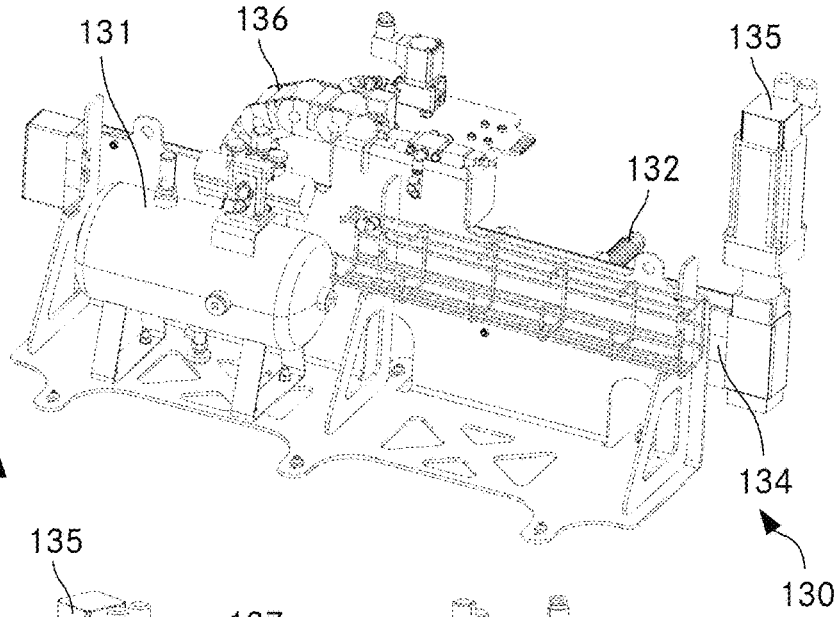
FIG. 8A, 8B two oblique views of the supply station for compressed air.
Figure 8B:
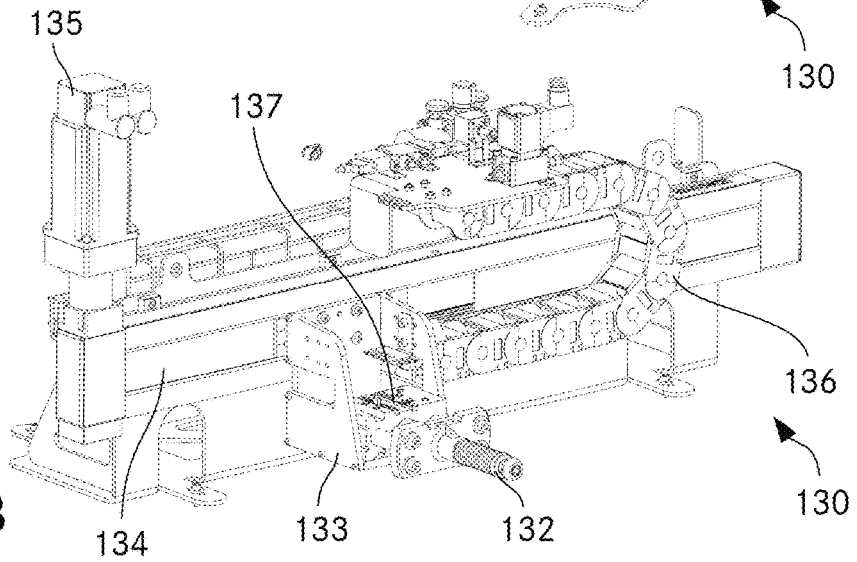

The FIGS. 8A, 8B are two oblique views of the supply station for compressed air. The air supply station 130 features a compressor and a tank 131 for storing compressed air. The tank 131 is connected to a supply pin 132 arranged on a carriage 133 that may be moved along a linear path by a belt drive 134 driven by a drive motor 135. The hose (not displayed) linking the tank 131 to the supply pin 132 is guided by a guide chain 136 such that high speed movements of the carriage 133 are enabled.

The supply pin 132 is mounted on the carriage 133 by means of a pneumatic cylinder 137, which allows for extending or retracting the supply pin 132 with respect to the carriage 133 in a direction perpendicular to the linear path. The free end of the supply pin 132 is provided by a valve, which is opened if a force acts against a valve tip extending from the supply pin 132. The geometry of the supply pin 132 is adapted to the air interface 162 of the base part 151 of the gripper conveyor 150 (cf. FIG. 6A).

Prior to a gripper conveyor 150 entering the air supply section of the circulating track 101, the carriage 133 is moved to its initial position. As soon as the gripper conveyor 150 is aligned with the carriage 133, the supply pin 132 is extended by means of the pneumatic cylinder 137. It enters the air interface 162 of the gripper conveyor 150, and the flow of compressed air is activated by the mechanical contact between a collar of the air interface 162 and the valve tip of the air supply pin 132. Next, the carriage 133 with the air supply pin 132 inserted into the air interface 162 follows the linear movement of the gripper conveyor 150 until a retraction point is reached. During this movement, pressurized air is introduced through the air interface 162 into the air reservoir 161 on the gripper conveyor 150. The amount of air is sufficient to operate the gripper mechanism of the gripper conveyor 150 during a full cycle on the circulating track. At the retraction point, the air supply pin 132 is retracted by means of the pneumatic cylinder 137, and the air supply is automatically stopped as soon as the valve tip loses mechanical contact with the air interface. Finally, the carriage 133 moves back to its initial position, in order to interact with the next guide conveyor.

Figure 9:
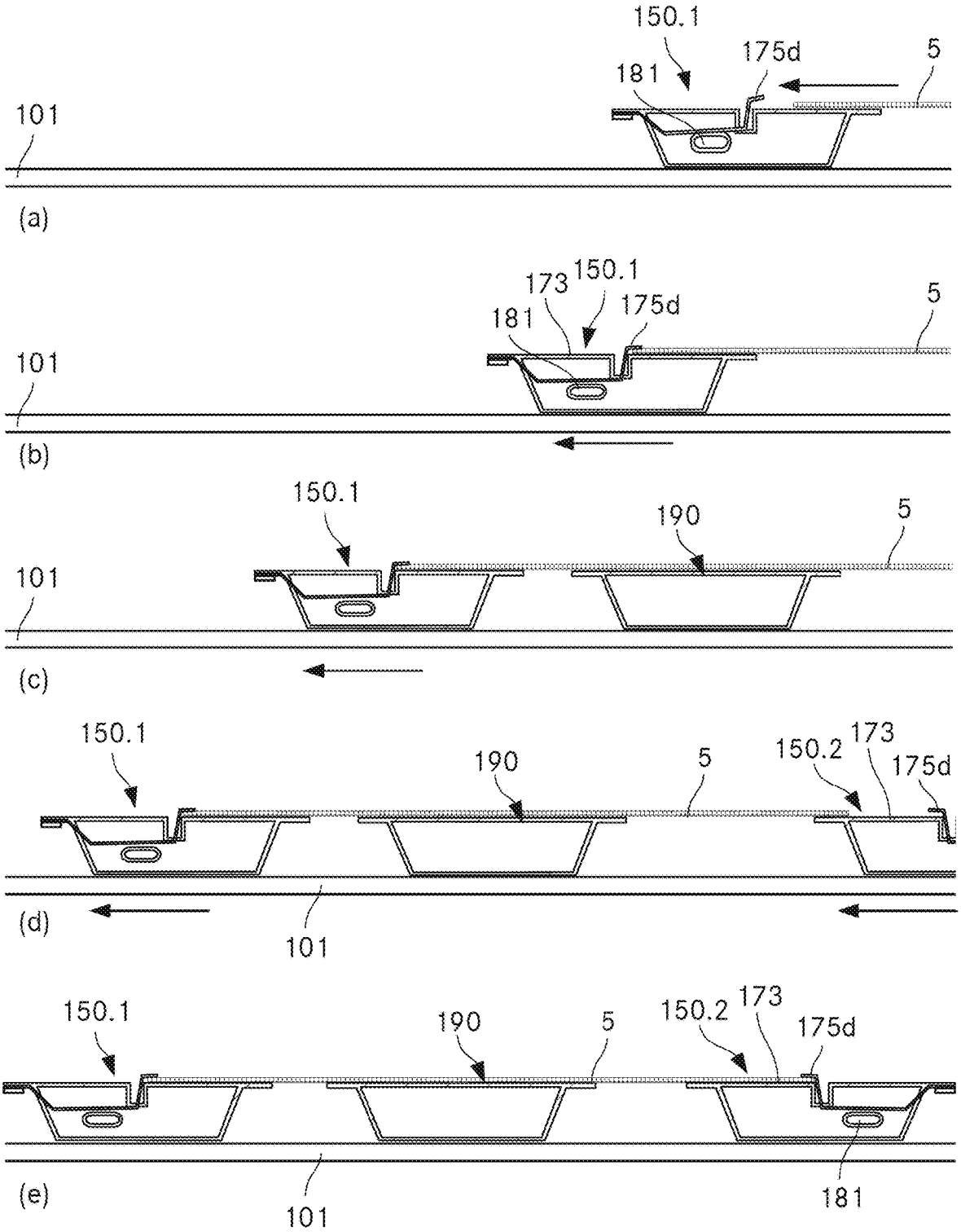
FIG. 9 a schematic illustration of the process of gripping of a sheet.

The FIG. 9 is a schematic illustration of the process of gripping of a sheet. As described above, the sheets 5 are fed from the second unit of the feeding station, held by the upper set of belts and a corresponding vacuum system. As shown in FIG. 9 (*a*), prior to feeding the sheet 5, the first gripper conveyor 150.1 is positioned along the circulating track 101 in a receiving position, a transport speed of the gripper conveyor 150.1 is less than a feeding speed of the sheet 5. In this section, the track 101 features a cam, which interacts with the control pin 164 of the gripper conveyor to inflate the tube 181. This opens the clamping elements 175*d* of the gripper conveyor 150.1. Held by the upper set of belts, the sheet 5 is inserted with its leading edge in between the clamping elements 175*d* and the upper surface 173 of the gripper conveyor 150. As soon as this has happened, the cam ends, the control pin 164 extends and the tube 181 is deflated. At this place, the belts end, i. e. the handover of the respective portion of sheet 5 to the conveyors of the transport system is finished. This leads to the situation depicted in FIG. 9 (*b*).

The first gripper conveyor 150.1 is further moved along the track 101 and a support conveyor 190 is moved below the sheet 5. The support conveyor 190 has the same buildup as the gripper conveyors 150, however there is no gripping mechanism and therefore no air reservoir or tube. The support conveyor 190 supports a middle section of the sheet 5 as shown in FIG. 9 (*c*).

Next, a second gripper conveyor 150.2 is moved along the track 101 with a transport speed bigger than the transport speed of the first gripper conveyor 150.1 with the sheet 5. Again, the clamping elements 175*d* are opened due to interaction of the control pin 164 with the cam. The trailing edge of the sheet 5 is received in between the clamping elements 175*d* and the upper surface 173 of the second gripper conveyor 150.2. Finally, as soon as the cam ends, the control pin 164 extends and the tube 181 is deflated. This leads to the situation depicted in FIG. 9 (*e*).

For the further processing of the sheet 5, the two gripper conveyors 150.1, 150.2 and the support conveyor 190 are moved along the track 101 essentially with identical speeds. In order to further improve the flatness of the sheet 5, the speeds of the two gripper conveyors 150.1, 150.2 may be adjusted to impart some tensioning force on the sheet 5 and/or the support conveyor 190 may be provided with a vacuum system for aspirating the middle portion of the sheet 5.

From receiving the sheets, during the entire processing the sheets and up to hand over the sheets to the removal station, the gripper conveyors do not require any energy supply. This is due to the following:

- the actuation of the gripping mechanism is based on a mechanical interaction between the control pin and the cam,
- the energy required for actuating the gripping mechanism is provided by the air reservoir on the gripping conveyor, and
- the energy for movement of the conveyors is delivered to the stationary electromagnets of the linear motor.

The only place where external energy is provided to the conveyors is the air supply station, as described above. Nevertheless, despite the passive nature of the conveyors, their movement along the track may be individually controlled. For this purpose, the control system of the printing machine is connected to appropriate sensors for determining the positions of all the grippers.

The handover of the sheets from the gripping conveyors to the removal station essentially corresponds to the feeding of the sheets. After handover, the gripper conveyors are further moved along the track, passing the first turning section, the lower linear section with the air supply station and the second turning section. Along a first part of the lower linear section, the speed of the conveyors is substantially higher than on the upper linear section. This allows for reducing the recirculation speed in the air supply station and ensures that the gripper conveyors are timely supplied for the next cycle.

The printing machine may further comprise a cleaning station for cleaning the gripper and support conveyors. It may be arranged in the vicinity of the air supply station.

The printing station 50 features a mechanism for individually setting the height of its four print bars relative to the (nominal) feeding height of the sheets. This allows for precisely adjusting the distance of the nozzles of the print-bars and the sheets. Thus, the printing station 50 is easily adapted to different sheet thicknesses. Furthermore, an encoder station with a distance sensor in the form of a laser curtain is provided upstream of the printing station 50, recording the profile of the sheet along the transport direction. The vertical adjustment of the print bars is controlled according to the recorded profile, such that local adjustment of the distance is enabled.

Furthermore, the four corners of the gripper bars are provided with visual markings. They are captured by a video system affixed to the stationary part of the print machine. Based on this data, the position and possible mis-orientations of the respective sheet are determined, and the print data is processed to compensate for the determined imprecisions.

In addition to the gripper and support conveyors, the printing machine may feature an absorbing conveyor for absorbing excess ink, especially ink used for flushing the inkjet nozzles. This buildup of this conveyor essentially corresponds to that of the gripper conveyors, however instead of a gripper mechanism there is a sponge like element for absorbing ink.

The transport system of the described printing machine allows for precise positioning and transport of sheets of different thicknesses, widths and lengths. All necessary adjustments may be effected dynamically, without substantially reducing the throughput. The passive gripper conveyors allow for a simple setup, low conveyor weight and reliable operation even at high operating speeds.

The invention is not restricted to the described embodiment. In particular, dimensions of the machine, the number and type of stations or the geometrical design of machine elements may be different from the shown examples.

In summary, it is to be noted that the invention creates a printing machine for printing individual sheets that allows for an increased flexibility and high throughput.

The invention claimed is:

1. An inkjet printing machine for printing individual sheets, comprising at least one printing station; and a transport system defining a transport track for transporting the individual sheets through the at least one printing station, along a transport direction;

the transport system comprising a plurality of gripper conveyors running along the transport track for holding the individual sheets during a printing process in the at least one printing station, wherein each of the plurality of gripper conveyors includes an energy storage for providing energy for operating a gripper mechanism of each of the plurality of gripper conveyors, and the energy storage of each of the plurality of gripper conveyors includes a compressed air reservoir.

2. The inkjet printing machine as recited in claim 1, wherein the transport system includes a supply station for supplying compressed air to the compressed air reservoir of each of the plurality of gripper conveyors.

3. The inkjet printing machine as recited in claim 2, wherein the supply station comprises a movable air supply interface for moving with one of the plurality of gripper conveyors, along a path section of the the one of the plurality of gripper conveyor.

4. The inkjet printing machine as recited in claim 1, wherein movement of each of the plurality of gripper conveyors is individually controllable along the transport track.

5. The inkjet printing machine as recited in claim 1, the transport system includes a circulating track, the plurality of gripper conveyors run along the circulating track, and the transport track forms a section of the circulating track.

6. The inkjet printing machine as recited in claim 5, wherein the circulating track extends in a first plane, the plurality of gripper conveyors are guided along the circulating track so that along the transport track a main surface of the individual sheets held by respective gripper conveyors of the plurality of gripper conveyors extends in a second plane, and the second plane is perpendicular to the first plane and oriented along the transport direction.

7. The inkjet printing machine as recited in claim 2, wherein the supply station is arranged in a region of the circulating track outside the transport track for the individual sheets.

8. The inkjet printing machine as recited in claim 1, wherein at least a first one of the plurality of gripper conveyors includes a first gripper mechanism for gripping a leading edge of one of the individual sheets and at least a second one of the plurality of gripper conveyors includes a second gripper mechanism for gripping a trailing edge of the individual sheets.

9. The inkjet printing machine as recited in claim 8, wherein the first gripper mechanism and/or the second gripper mechanism includes a clamping bar, the clamping bar includes a first cross member and a second cross member, a relative distance of the first cross member and the second cross member is adjustable to clamp the leading edge and/or the trailing edge of the individual sheet.

10. The inkjet printing machine as recited in claim 8, wherein the transport system further includes support conveyors for supporting the individual sheets in a central portion thereof.

11. The inkjet printing machine as recited in claim 1, wherein the at least one printing station includes a plurality of inkjet print bars, and the plurality of inkjet print bars cover a print area extending across the transport track for the individual sheets.

12. The inkjet printing machine as recited in claim 11, further comprising an absorbing conveyor for absorbing excess ink when moved to an absorbing position opposite at least one of the plurality of inkjet print bars, wherein the absorbing conveyor is movable along the transport track.

13. The inkjet printing machine as recited in claim 11, wherein the plurality of inkjet print bars are individually and dynamically movable in an adjustment direction perpendicular to a main surface of the individual sheets to be printed, so that a distance between the plurality of inkjet print bars and a respective individual sheet is dynamically adjustable.

14. The inkjet printing machine as recited in claim 13, further comprising a detection unit for recording a profile of one of the individual sheets to be printed, the recording the profile of the one of the individual sheets to be printed includes recording a bending along the transport direction, and further comprising a control unit for controlling a movement of the plurality of inkjet print bars in the adjustment direction, based on the recorded bending along the transport direction.

15. The inkjet printing machine as recited in claim 1, comprising a detection device for capturing positions and orientations of two gripping conveyors of the plurality of gripping conveyors assigned to an individual sheet, and further comprising a control device for controlling the at least one printing station to compensate for positional inaccuracies of the individual sheet transported by the two gripping conveyors.

* * * * *